United States Patent [19]

Glaesmann et al.

[11] 4,362,440

[45] Dec. 7, 1982

[54] TUBULAR LOST BOREHOLE CLOSURE

[75] Inventors: Otto-Ernst Glaesmann, Dortmund; Frank Meyer, Essen; Walter Marsch, Recklinghausen, all of Fed. Rep. of Germany

[73] Assignee: Bergwerksverband GmbH, Essen, Fed. Rep. of Germany

[21] Appl. No.: 115,289

[22] Filed: Jan. 25, 1980

[30] Foreign Application Priority Data

Jan. 27, 1979 [DE] Fed. Rep. of Germany ..... 2903137

[51] Int. Cl.[3] ..... E21D 20/02

[52] U.S. Cl. ..... 405/269; 405/260; 52/161

[58] Field of Search ..... 405/236, 240, 258–260, 405/263, 266, 269; 166/325, 267, 268, 242; 52/156, 161

[56] References Cited

U.S. PATENT DOCUMENTS

| | | | |
|---|---|---|---|
| 2,913,052 | 11/1959 | Harmon | 166/242 |
| 2,960,831 | 11/1960 | Lonaberger et al. | 405/263 |
| 3,012,608 | 12/1961 | McLaren | 166/242 |
| 3,908,386 | 9/1975 | Williams | 405/260 |

FOREIGN PATENT DOCUMENTS

| | | | |
|---|---|---|---|
| 387084 | 8/1973 | U.S.S.R. | 405/269 |
| 601425 | 4/1978 | U.S.S.R. | 405/260 |

*Primary Examiner*—David H. Corbin
*Assistant Examiner*—Nancy J. Pistel
*Attorney, Agent, or Firm*—Michael J. Striker

[57] ABSTRACT

A borehole closure, especially for injection of plastic material or cement into a borehole formed into rock for solidifying the latter and comprising a tube, a one-way valve connected to the leading end of said tube, a holding element including a spreading cone cooperating with a spreadable shell surrounding the tube in the region of its leading end, which in turn is followed by an axially compressible and radially expandable sealing element in form of a rubber sleeve surrounding the tube. In order to place the lost borehole closure at any desired distance from the outer end of the borehole, a plurality of tube sections and connecting bushings are provided for connecting the tube sections with different restraining forces to each other and to the trailing end of the tube, with one of the tube sections extending beyond the outer end of the borehole. An anchor plate may be provided surrounding the tube section projecting beyond the outer end of the borehole and is held against the rock by a lockscrew so that the arrangement may be used as a spreading anchor. A screw nipple is fixed to the outer end of the one tube section for turning the latter and the other tube sections and the tube connected thereto to thereby radially expand the spreadable shell of the holding element and the sealing element.

4 Claims, 1 Drawing Figure

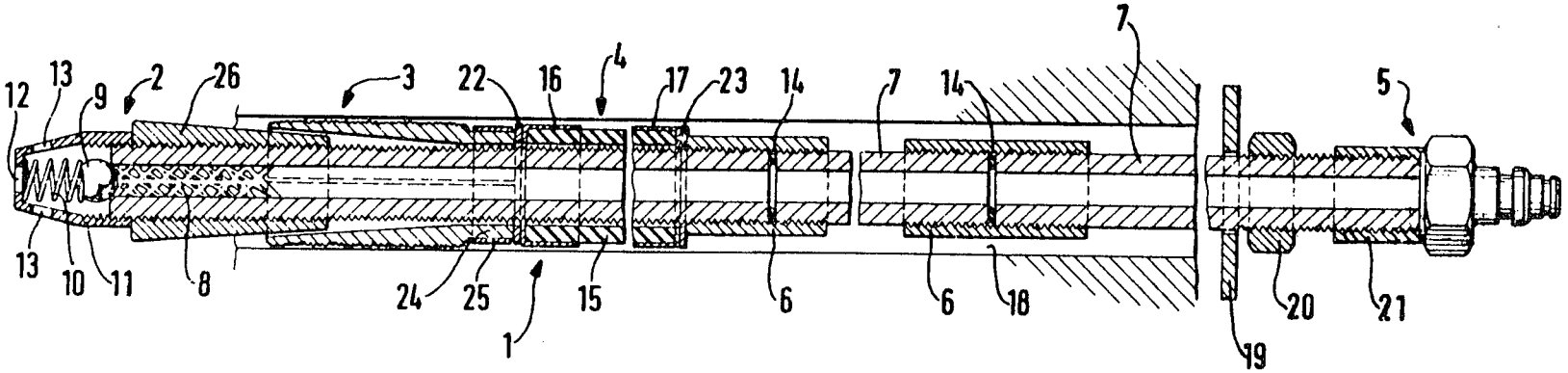
5
21
20
19
7
14
18
6
7
14
6
23
17
4
16
15
1
22
25
24
3
26
8
2
9
11
10
13
12
13

TUBULAR LOST BOREHOLE CLOSURE

BACKGROUND OF THE INVENTION

The present invention relates to tubular lost borehole closures, especially for injection of plastic material or the like into a borehole for consolidation of rock, and essentially comprising a tube provided with a return flow guard, a holding element and a sealing element, in which a spanning element in form of a screw nipple serves to span the sealing and holding elements.

Such a tubular lost borehole closure for injection of plastic material is known in the art and for instance disclosed in the German Pat. No. 25 50 555. This known tubular lost borehole closure comprises a tube forming a throttle passage and surrounded by a hose section consisting of elastic material and serving only as a sealing element which at opposite ends is provided with sliding discs by means of which it is guided on the tube. This known lost borehole closure comprises further a holding element including a spreading cone threadingly connected to a portion of the tube and cooperating with a spreadable bushing and an abutment disc likewise threadingly connected to the tube. A spanning element in form of a screw nipple which is screwed onto another portion of the tube serves to span the sealing element and the holding element.

A disadvantage of this known lost borehole closure is that it can only be applied in the region of the outer end of the borehole, that it does not have a sufficient return flow guard and that the mixing of the material to be injected has to be carried out outside of this known borehole closure.

This known lost borehole closure has already been further developed by providing at the leading end thereof a return flow guard comprising a spring biased ball valve arranged in a housing provided at the axis of the tube with an opening at the front of the housing.

However, despite this improvement of the known lost borehole closure it has still the decisive disadvantage that it may not be used at any position of the borehole. In addition, the above-mentioned return flow guard has certain disadvantages, especially that, when the spring is compressed by the pressure of the medium to be injected, the throughflow of the injected medium will not be assured.

SUMMARY OF THE INVENTION

It is an object of the present invention to provide a tubular lost borehole closure, especially for the injection of plastic material, which avoids the disadvantages of the lost borehole closures known in the art.

It is especially an object of the present invention to provide a tubular lost borehole closure which can be arranged at any desired portion of the borehole, which is provided with a return flow guard which will properly function during injection of the material, and which permits a mixing of the material to be injected within the tube.

It is an additional object of the present invention to provide a lost borehole closure which may, if desired, also be used as a spreading anchor.

With these and other objects in view, which will become apparent as the description proceeds, the lost borehole closure according to the present invention serving especially for injection of suitable media, such as plastic or cement, into a borehole for consolidation of rock, mainly comprises a tube provided with an outer screw thread, a one-way valve having a housing threadingly connected to the leading end of the tube, holding means and sealing means surrounding said tube rearwardly of the housing, an axially compressible to be radially expandable by turning the tube, extension means for placing the tube at any selected distance from the outer end of the borehole and comprising a plurality of tube sections and connecting bushings for connecting said tube sections with different restraining forces respectively to each other and to the trailing end of the afore-mentioned tube, with one of the tube sections projecting beyond the outer end of the borehole, and a screw nipple connected to the outer end of the one tube section for turning the tube sections and the tube and to thereby axially compress and radially expand the sealing and holding means. The tube includes also a mixing element in the region of the leading end thereof.

The mentioned one-way valve comprises a ball, a coil compression spring in the housing abutting with opposite ends against the ball and a portion of the housing opposite the leading end of the tube and the housing is formed not only with one opening coaxially with the axis of the tube, but with additional openings at lateral portions of the housing. This will assure that even if the spring is totally compressed by the pressure of the injection material, the latter may still flow out of tube through the lateral openings in the housing.

The sealing means according to the present invention comprise a hose section surrounding a portion of the housing and formed from rubber of a shore hardness of 40–80 and mounted on the tube by metal shells surrounding opposite ends of the hose section.

In addition, the arrangement according to the present invention may also be used as a spreading anchor by mounting on the tube section projecting beyond the outer end of the borehole an anchor plate and a locknut for pressing the anchor plate against the surface surrounding the outer end of the borehole.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing shows a longitudinal section through the lost borehole closure according to the present invention inserted into a borehole.

DESCRIPTION OF THE PREFERRED EMBODIMENT

Referring now to the drawing, it will be seen that the borehole closure according to the present invention comprises a tube 1 provided with an outer screwthread and a return flow guard 2 threadingly connected to the leading end of the tube 1. The return flow guard 2 comprises a substantially frustoconical housing 11 flattened at its outer end, which is provided with a central opening 12 and the housing is in addition provided in the side walls thereof with additional lateral openings 13. A spring-biased ball valve comprising a ball 9 and a coil compression spring 10 is located within the housing 11. The spring 10 presses the ball 9 against the outer end of the passage through the tube 1 through which the material is to be injected. During such an injection the pressure of the injected material will open the valve and the medium under pressure will flow through the openings 12 and 13 into the borehole 18. If the injection is interrupted the ball 9 will be pressed by the combined pressure of the spring 10 and that of the injected material again against its original seat. If during injection the spring 10 is totally compressed outflow through the central opening 12 is prevented, but the material may still flow out through the additional lateral opening 13.

A holding element 3 surrounds the tube 1 rearwardly of the return flow guard 2. The holding element comprises a spreading cone 26 provided with an inner screw thread threadingly engaged with the outer screw thread of the tube 1 and preferably abutting with a front end thereof against the rear end of the housing 11. A rear portion of the spreading cone 26 extends into a corresponding conical surface formed by a plurality of metal shells provided at the rear ends thereof with a collar 24 surrounded by a band 25.

At least one sealing element 4 surrounds the tube 1 rearwardly of the holding element 3. The sealing element 4 has a front end closely adjacent to the collar 24 and comprises a sleeve 15 of elastic material, preferably rubber, with a shore hardness of 40–80. Opposite ends of the sealing element 4 are encompassed by sheet metal shells 16 and 17. The shore hardness of the sealing element 4 is chosen in accordance with the hardness of the rock in which the borehole 18 is provided. A slide disc 22 is sandwiched between the collar 24 and the bottom of the shell 16. An additional slide disc 23 engages the bottom of the shell 17.

Rearwardly of the disc 23 there is screwed a connecting bushing onto the outer thread of the tube 1 and the bushing is fixedly connected to the tube. A tube section 7 is screwed into the bushing 6 with a seal 14 in form of a disc or in form of O-ring sandwiched between the facing ends of the tube 1 and the tube section 7. By means of a selected number of connecting bushings and tube sections, it is possible to place the borehole closure at any desired location within the borehole 18. Thereby, it is possible by different construction of the sealing elements 14 to disconnect the structure formed by the plurality of tube sections 7 and the connecting bushing connecting the same from the tube 1. Such disconnection may for instance be made by providing in the bushing 6, which connects the first tube section 7 to the tube 1, an O-ring and in the other connection bushings seals 14 in form of sealing discs which have a greater friction.

The use of any number of tube sections 7 and connecting bushings 6 not only permits placing the borehole closure at any desired location within the borehole, but this permits also in connection with an anchor plate 19 surrounding a tube section extending beyond the borehole and a locknut 20, to use the borehole closure as a spreading anchor.

A screw nipple 5 is threaded with portion 21 onto a portion of a tube section projecting beyond the outer end of the borehole and serving as a spanning element. By turning the screw nipple 5 and therewith the tube sections 7 with the corresponding connecting bushings 6 and the connecting bushing 6 which is fixed to the trailing end of the tube 1 rearwardly of the sealing element 4, the holding element 3 and the sealing element 4 are actuated since due to the frictional engagement of the outer conical surface of the spreading cone 26 with the inner conical surface of the metal shells and the frictional engagement of the outer surface of the latter with the bore hole, the holding element 3 is expanded during turning of the tube 1 and subsequently thereto the sealing element is axially compressed and thereby also radially expanded into tight engagement with the bore hole.

At least one mixing element 8 of known construction is arranged within the tube 1 rearwardly of the return flow guard 2. The mixing element 8 is formed in accordance with the inner diameter of the tube 1 and mixes the injected media in dependence on the flow through-speed thereof. The use of one or a plurality of sequentially arranged mixing elements 8 is chosen in accordance with the media to be injected.

It will be understood that each of the elements described above, or two or more together, may also find a useful application in other types of tubular lost borehole closures differing from the types described above.

While the invention has been illustrated and described as embodied in a tubular lost borehole closure especially for injection of plastic material into a borehole for consolidation of rock, it is not intended to be limited to the details, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A lost borehole closure, especially for injection of suitable media, such as for instance plastic, into boreholes for consolidation of rock, comprising a tube having a leading end and a trailing end, each provided with an outer screw thread; a one-way valve having a housing threadingly connected to the leading end of said tube; holding means and sealing means surrounding said tube rearwardly of said housing, said holding means and said sealing means being axially compressible and radially expansible by turning said tube; extension means for placing said tube at any selected distance from the outer end of the borehole and comprising a plurality of tube sections and connecting bushings for connecting said tube sections with different restraining forces respectively to each other and to said trailing end of said tube, with one of said tube sections projecting beyond the outer end of the borehole; a screw nipple connected to the outer end of said one tube section for turning said tube sections and said tube to thereby axially compress and radially expand said sealing means and said holding means; and including a mixing element in said tube in the region of the leading end thereof.

2. A lost borehole closure, especially for injection of a suitable media, such as for instance plastic, into boreholes for consolidation of rock, comprising a tube having a leading and a trailing end, each provided with an outer screw thread; a one-way valve having a housing threadingly connected to the leading of said tube; extension means for placing said tube at a selected distance from the outer end of said borehole and comprising a plurality of tube sections and connecting bushings for connecting said tube sections with different restraining forces respectively to each other and to said trailing end of said tube; holding means and sealing means surrounding said tube rearwardly of said housing, said holding means and said sealing means being axially compressible and radially expansible by turning said tube, said holding means comprising a spreading cone having an inner screw thread threadingly engaged with said outer screw thread at the leading end of said tube and abutting with one end against said housing and spreadable means having an inner conical surface, a portion of said spreading cone opposite said one end thereof engaging with its outer surface said inner conical surface of said spreadable means, said sealing means comprising a sleeve of rubber adjacent said spreadable means and including slide disks respectively sandwiched between one end of said spreadable means and the facing end of said sealing means and the opposite end of said sealing means and an end face of that connecting bushing which connects said trailing end of said tube with a tube section adjacent thereto; and a screw nipple connected to the outer end of said one tube section for turning said tube sections and said tube to thereby axially compress and radially expand said sealing and said holding means.

3. A lost borehole closure, especially for injection of suitable media, such as for instance plastic, into boreholes for consolidation of rock, comprising a tube having a leading and a trailing end, each provided with an outer screw thread; a one-way valve having a housing threadingly connected to the leading end of said tube; holding means and sealing means surrounding said tube rearwardly of said housing, said holding means and sealing means being axially compressible and radially expansible by turning said tube; extension means for placing said tube at any selected distance from the outer end of the borehole and comprising a plurality of tube sections and connecting bushings for connecting said tube sections with different restraining forces respectively to each other and to said trailing end of said tube; a plurality of sealing elements of different construction in said connecting bushing between facing ends of said tube sections and between said trailing end of said tube and said facing end of the tube section adjacent thereto, the sealing element between said trailing end of said tube and the facing end of the tube section adjacent thereto being an O-ring and the sealing elements between facing ends of said tube sections being sealing disks providing a greater friction than said O-ring; and a screw nipple connected to the outer end of said one tube section for turning said tube sections and said tube to thereby axially compress and radially expand said sealing means and said holding means.

4. A lost borehole closure, especially for injection of suitable media, such as for instance plastic, into boreholes for consolidation of rock, comprising a tube having a leading end and a trailing end, each provided with an outer screw thread; a one-way valve having a housing threadingly connected to the leading end of said tube; holding means and sealing means surrounding said tube rearwardly of said housing, said holding means and said sealing means being axially compressible and radially expansible by turning said tube, said sealing means comprising a sleeve of rubber of a shore hardness of 40–80 and sheet metal shells surrounding opposite ends of said sleeve; extension means for placing said tube at any selected distance from the outer end of the borehole and comprising a plurality of tube sections and connecting bushings for connecting said tube sections with different restraining forces respectively to each other and to said trailing end of said tube, with one of said tube sections projecting beyond the outer end of the borehole; and a screw nipple connected to the outer end of said one tube section for turning said tube sections and said tube to thereby axially compress and radially expand said sealing means and said holding means.

* * * * *